US010076227B2

(12) United States Patent
Büsing et al.

(10) Patent No.: US 10,076,227 B2
(45) Date of Patent: Sep. 18, 2018

(54) DISHWASHER

(75) Inventors: Johannes Büsing, Emersacker (DE); Daniel Delle, Bächingen (DE); Gerhard Fetzer, Gundelfingen (DE); Peter Geissler, Holzheim (DE); Norbert Gerstner, Herbrechtingen (DE); Hubert Groll, Mödingen (DE); Mathias Herrmann, Dischingen (DE); Dieter Hotz, Dischingen (DE); Stefan Kasbauer, Dillingen (DE); Michael Georg Rosenbauer, Reimlingen (DE); Bernd Schessl, Dillingen (DE)

(73) Assignee: BSH Hausgeräte, Munich (DE)

( * ) Notice: Subject to any disclaimer, the term of this patent is extended or adjusted under 35 U.S.C. 154(b) by 922 days.

(21) Appl. No.: 13/636,342

(22) PCT Filed: Feb. 28, 2011

(86) PCT No.: PCT/EP2011/052872
§ 371 (c)(1),
(2), (4) Date: Oct. 2, 2012

(87) PCT Pub. No.: WO2011/117044
PCT Pub. Date: Sep. 29, 2011

(65) Prior Publication Data

US 2013/0134846 A1 May 30, 2013

(30) Foreign Application Priority Data

Mar. 26, 2010 (DE) ..... 10 2010 003 355

(51) Int. Cl.
*A47L 19/02* (2006.01)
*A47L 15/42* (2006.01)

(52) U.S. Cl.
CPC ..... *A47L 15/4274* (2013.01); *A47L 15/4265* (2013.01); *A47L 15/4293* (2013.01);
(Continued)

(58) Field of Classification Search
CPC ..... A47L 15/4265; A47L 15/4293
(Continued)

(56) References Cited

U.S. PATENT DOCUMENTS 2,153,851 A * 4/1939 Swedman ..... 362/94
2,339,085 A * 1/1944 Luckiesh ..... 62/264
(Continued)

FOREIGN PATENT DOCUMENTS

EP 1421893 B1 3/2005
EP 1576632 B2 12/2008
(Continued)

OTHER PUBLICATIONS

International Search Report PCT/EP2011/052872.

*Primary Examiner* — Daniel J Troy
*Assistant Examiner* — Timothy Michael Ayres
(74) *Attorney, Agent, or Firm* — Michael E. Tschupp; Andre Pallapies; Brandon G. Braun

(57) ABSTRACT

A dishwasher, in particular a free-standing dishwasher or a high-level built-in dishwasher, includes an appliance door and a bottom-side plinth cover which is aligned essentially flush with a front face of the appliance door. The plinth cover has a top wall which faces a lower edge of the appliance door and is spaced from the lower edge of the appliance door to allow for an opening movement of the appliance door across a free movement gap. At least one lighting element is provided to allow illumination of the movement gap between the lower edge of the appliance door and the top wall of the plinth cover.

11 Claims, 3 Drawing Sheets

(52) U.S. Cl.
CPC ..... *A47L 15/4257* (2013.01); *A47L 15/4261* (2013.01); *A47L 15/4263* (2013.01)

(58) Field of Classification Search
USPC ..... 134/56 DD; 312/228; 340/603
See application file for complete search history.

(56) References Cited

U.S. PATENT DOCUMENTS

| | | | | |
|---|---|---|---|---|
| 2,795,691 | A * | 6/1957 | Solley, Jr. et al. | 362/94 |
| 3,837,917 | A * | 9/1974 | Jenkins et al. | 134/144 |
| 4,748,543 | A * | 5/1988 | Swarens | 362/147 |
| 5,860,436 | A * | 1/1999 | Hobday | 134/58 D |
| 5,873,646 | A * | 2/1999 | Fjaestad et al. | 362/92 |
| 7,157,667 | B2 * | 1/2007 | Gramlich et al. | 219/391 |
| 2009/0129114 | A1 * | 5/2009 | Buesing et al. | 362/600 |
| 2010/0147338 | A1 | 6/2010 | Büsing et al. | |

FOREIGN PATENT DOCUMENTS

| | | | |
|---|---|---|---|
| WO | 2006013009 | A1 | 2/2006 |
| WO | 2006069831 | A1 | 7/2006 |
| WO | 2008073049 | A1 | 6/2008 |

* cited by examiner

DISHWASHER

BACKGROUND OF THE INVENTION

The invention relates to a dishwasher, in particular a free-standing dishwasher or a high-level built-in dishwasher, having an appliance door and at the bottom a plinth cover aligned substantially flush with an appliance front face. Said plinth cover has a top wall which faces towards a lower edge of the appliance door and is spaced from the lower edge of the appliance door to allow for an opening movement of the appliance door across a free movement gap.

Dishwashers have optical status indicators which indicate proper operation of the dishwasher and/or the operating status of a wash program for washing and/or drying dishes and utensils. In fully-integrated dishwashers, which are essentially free of operator control and display means and are built into a line of units and covered by a counter top matched to the line of units in order to match the appliance front of the line of units, such status indicators can, for example, illuminate an edge gap between the dishwasher and adjacent kitchen units in order to indicate the operating status, as is known from DE 10 2005 047 914 A1.

As an alternative, a dishwasher which can be built under and in whose plinth recess a lighting element is arranged and directed towards the floor and thus indicates an operating status of the dishwasher, is known from EP 1 421 893 A1 and EP 1 576 632 A1.

Apart from the above-mentioned appliance types, dishwashers which are free-standing are known. Such a generic type of free-standing appliance is known from DE 10 2004 046 753 A1. In contrast to the above-mentioned appliance types, the free-standing appliance cannot be joined to the walls of adjacent units or to a kitchen counter top running above it. Such types of free-standing dishwashers therefore react more sensitively to tilting moments than fully-integrated dishwashers, for example.

Therefore, to prevent tilting of the free-standing appliance, the front feet of the appliance must be placed further forward. The mounting base of the dishwasher therefore extends up to the front face of the appliance. The front face of the mounting base is provided with a plinth cover. In contrast to appliances which can be built under, for instance, this is not displaced rearwards via a plinth recess, but is aligned essentially flush with the front face of the appliance. Moreover, the bottom plinth cover has top wall facing the lower edge of the appliance door, which is spaced from the lower edge of the appliance door to ensure a pivoting motion of the appliance door across a free movement gap, thereby preventing a collision between the lower edge of the appliance door and the plinth cover.

Washing machines can also be constructed as integrated appliances which are inserted into a line of kitchen units, it being possible for a counter top to be arranged as a cover above the washing machine and the line of kitchen units.

Furthermore, it is known for washing machines to be of the high-level built-in type, that is to say the washing machine is inserted into a line of kitchen units, it being possible for the section underneath the washing machine to be likewise covered by a counter top which covers a drawer, for example. In this case, no plinth recess is provided, but a drawer, for example, is provided in this area.

Finally, drawer-type dishwashers are known, which instead of a hinged appliance door, which can for example be swung forward about a bottom swivel axis, in order to open a wash container, have an appliance door configured as a drawer which is not hinged but can be withdrawn like a kitchen drawer, it being possible for the wash container to have, like a kitchen drawer, an upwards-directed opening for loading dishes and utensils, that is to say an opening oriented opposite to the direction of the swivel force.

BRIEF SUMMARY OF THE INVENTION

The problem of the invention is to provide a dishwasher, in particular a free-standing dishwasher or a high-level built-in dishwasher, with an easily visible light indicator, it being possible for the lighting element to be arranged so as to be essentially concealed.

According to the characterizing part of claim 1, the dishwasher has at least one lighting element with which the movement gap between the lower edge of the appliance door and the top wall of the plinth cover can be illuminated. The light of the lighting element can therefore be directed outwards by the movement gap, whereas the lighting element can be placed essentially out of sight in the free movement gap in order to indicate operating states of the dishwasher, such as "ready" or "running" or error states such as "no salt or "no rinse aid". This can involve a free-standing dishwasher, a dishwasher designed as an integrated appliance, a high-level built-in dishwasher or a drawer dishwasher.

Here the lighting element can be disposed in a depth direction behind the front face of the appliance, that is to say on the inside of the dishwasher, since no constructional space for the lighting element is available directly at the appliance front face of the dishwasher.

It is particularly preferred if the top wall of the plinth cover is configured as a reflector which reflects the light radiated by the lighting element outwards through the movement gap of the appliance front face. Consequently, the luminous efficiency of the lighting element is further increased. Preferably in this case the profile shape of the top wall of the plinth cover can follow an approximate shape of the pivoting movement of the lower edge of the appliance door. The resulting oblique and curved top wall can therefore deflect the light outwards through the movement gap approximately horizontally since this profile shape produces light reflections in the desired directions.

The appliance door of the dishwasher is hinged and able to move in the usual manner about a bottom pivot axis. In the closed position, the appliance door can partially cover the plinth cover with its lower edge. Consequently, an undercut in which the lighting element can be disposed so as to be concealed, can be formed in the area behind the lower edge of the appliance door.

Against this background, it is preferred if the lighting element is positioned with a certain degree of offset behind a front face of the appliance door. Furthermore, the lighting element can be disposed by a height difference above the above-mentioned lower edge of the appliance door, whereby the lighting element is located so as to be completely concealed.

According to one embodiment, the lighting element can be directly retained at a rear face of the appliance door, which faces away from the front face of the appliance door. In this case, the lighting element is motion-coupled to the appliance door, that is to say the lighting element follows a pivoting movement of the appliance door. Therefore, in order to ensure a reliable power supply, this pivoting movement should be taken into account when designing the electrical power supply.

As an alternative to this, the lighting element can be retained independently of the appliance door at a fixed housing component of the dishwasher. Due to the fixed mounting of the lighting element, power supply leads to the lighting element can be installed essentially more simply.

Preferably, the lighting element can include a light guide which has at least one optical interface into which the light of a light source, for instance a LED, can be introduced. The light can be transmitted by means of the light guide more or less loss-free to light exit surfaces through which the light is emitted by the light guide.

Preferably, the light guide can extend essentially over the entire width of the dishwasher in the lateral direction of the appliance. In this case the light guide can run approximately parallel to the lower edge of the appliance door.

In order to increase the luminous efficiency, in the lateral direction of the appliance, at its opposing front faces the elongated light guide can in each case have optical interfaces into which the light can be introduced in each case by laterally disposed light sources.

BRIEF DESCRIPTION OF THE DRAWING

Two exemplary embodiments of the invention are described below with the aid of the accompanying figures, in which.

DETAILED DESCRIPTION OF EXEMPLARY EMBODIMENTS OF THE PRESENT INVENTION

Figure 1:
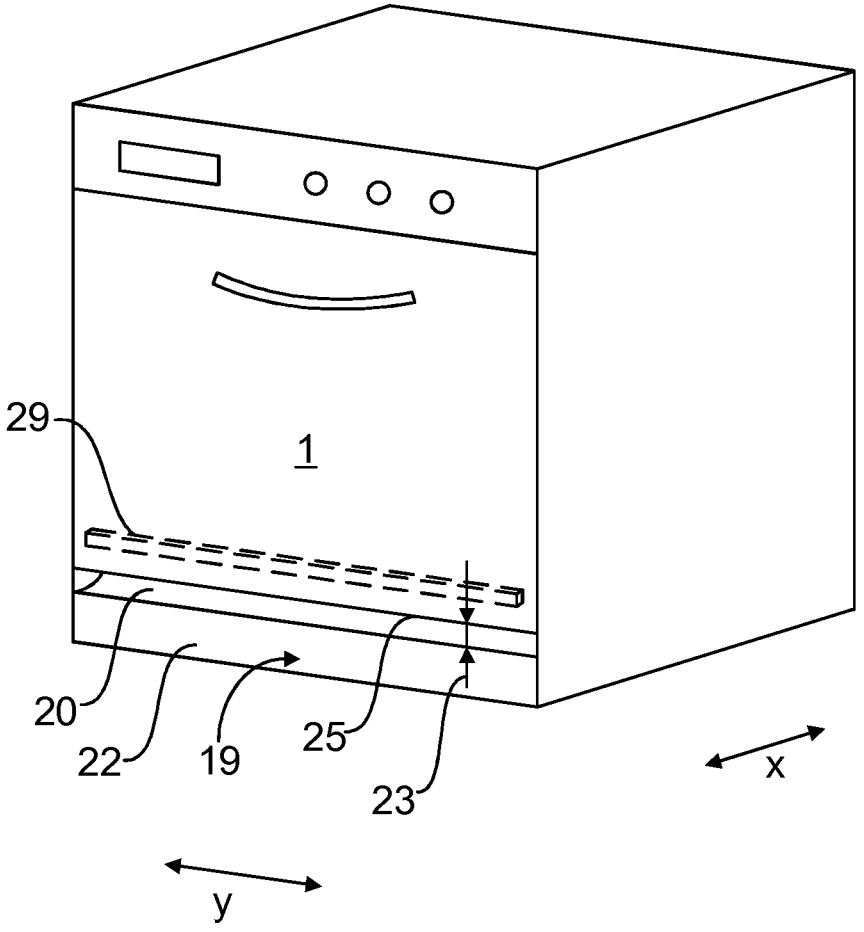
FIG. 1 shows a perspective view of a dishwasher realized as a free-standing appliance according to a first exemplary embodiment.

FIG. 1 shows as an exemplary embodiment a dishwasher realized as a free-standing appliance or intended as a high-level built-in appliance. It can also be designed as an integrated appliance or a drawer dishwasher. The dishwasher has an appliance door 1 with which a front loading opening of the wash container 3, indicated only by the dash-dot line, can be closed. The appliance door 1 is hinged to a housing of the dishwasher by a bottom, horizontal pivot axis. In addition, according to FIG. 2, the appliance door 1 is supported at both sides in the usual pivoted manner at lateral hinge brackets 5 fixed to the housing by means of lateral hinge levers.

As is further revealed in FIG. 1, the dishwasher has a bottom plinth cover 19 which is spaced from a lower edge 25 of the appliance door 1 via a free movement gap 23. The gap dimension of the movement gap 23 is designed so that, with a hinged movement of the appliance door 1, the lower edge 25 of the appliance door cannot collide with an opposing top wall 20 of the plinth cover 19. According to FIG. 2, the profile of the top wall 20 of the plinth cover 19 is formed with an approximately curved trough shape. Apart from this top wall 20, the plinth cover 19 has a front wall 22 and a bottom wall 24. In this case the front wall 22 of the plinth cover 19 is oriented approximately flush with a front face 28 of the appliance door 1. The plinth cover 19 is mounted on a support 26 which in turn is located at the front face on a mounting base 13.

The mounting base 13 is provided underneath the wash container 3. Appliance components of the dishwasher, for instance circulating pump or washing liquor pump, are located inside the mounting base 13.

Figure 2:
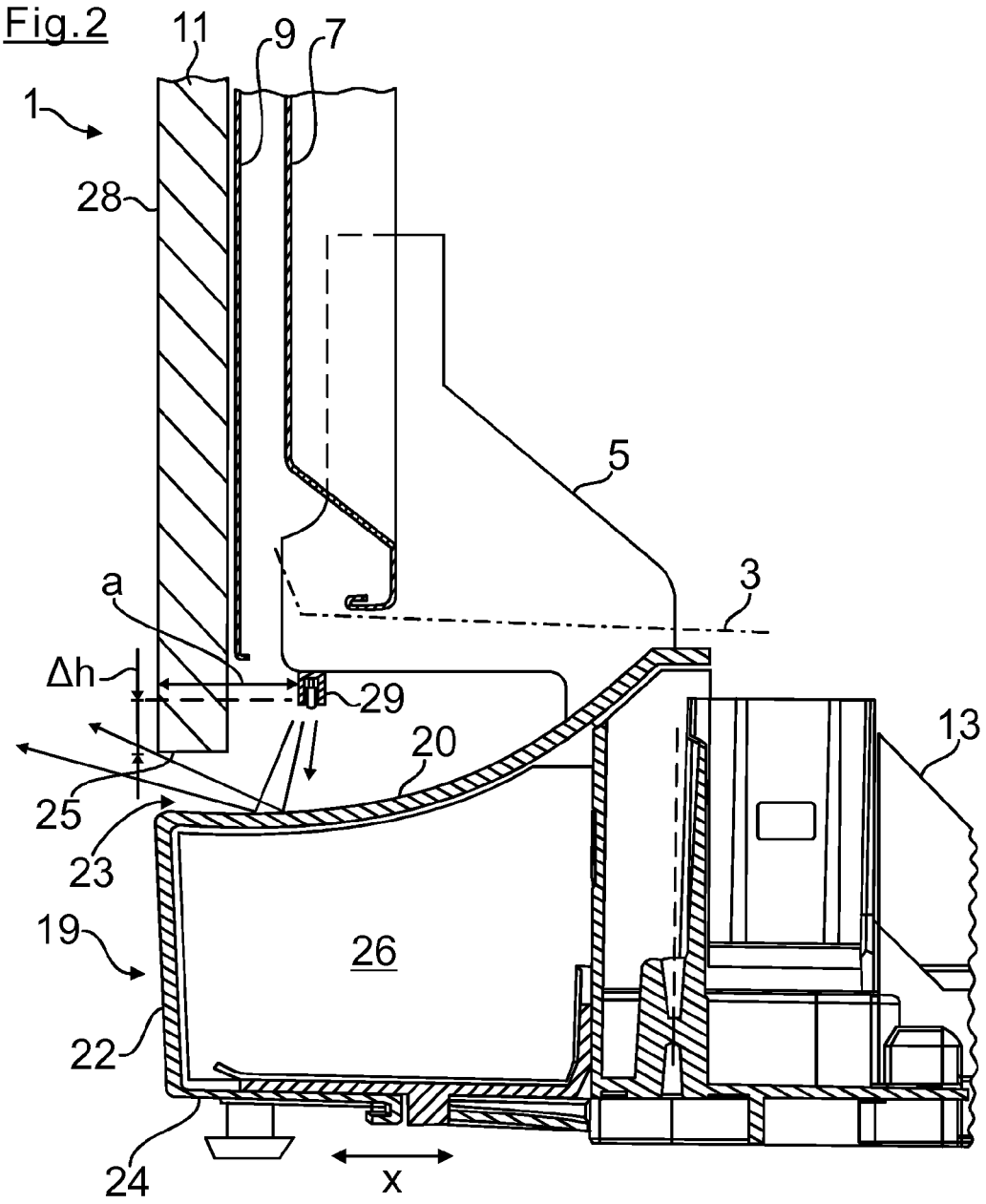
FIG. 2 shows a partial sectional view of a bottom section of the dishwasher.

As is further revealed in FIG. 2, the appliance door 1 is constructed with an inner door panel 7 and an outer door panel 9. The outer door panel 9 of the appliance door 1 is covered at the front by a cabinet panel 11 which forms the lower edge 25 of the appliance door 1 in FIG. 2.

As is further revealed in FIG. 2, a lighting element 29 is located behind the cabinet panel 11 of the appliance door 1. The lighting element 29 is placed in a concealed manner behind the front face 28 of the appliance door 1 by an offset dimension a. In addition, the lighting element 29 is permanently attached to the housing by a height difference $\Delta h$ above the lower edge 25 of the appliance door, for example mounted on the two lateral hinge brackets 5. As an alternative to this, the lighting element 29 can also be retained on other fixed components of the dishwasher.

The lighting element 29 indicated in FIG. 2 has a U-profile shaped housing extending in the lateral direction y of the appliance, which has a light aperture. A light source 31 is located in the housing. The light source 31 of the lighting element 29 can consist for example of a number of light-emitting diodes which are arranged in a row in the lateral direction y of the appliance.

According to FIG. 2, the trough-shaped, upwards-drawn top wall 20 of the plinth cover 19 is directly illuminated with light by means of the lighting element 29. Here, for uniform illumination of the gap, the lighting element 29 extends in the lateral direction y of the appliance over the entire width of the dishwasher. In this case, the angle of incidence of the light from the lighting element 29 on the top wall 20, and the profile shape of the top wall 20 are designed so that the light is deflected essentially horizontally outwards through the movement gap 23.

Figure 3:
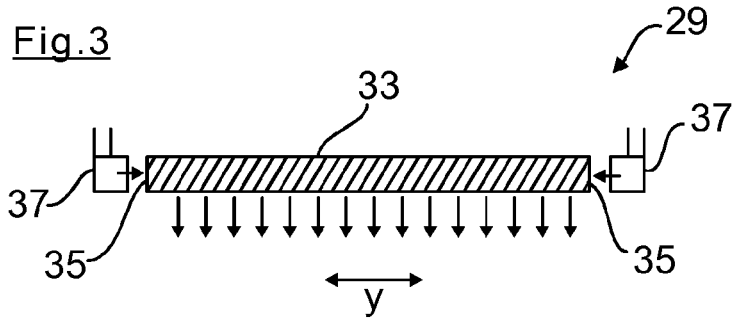
FIG. 3 shows an individual lighting element of the dishwasher.

In FIG. 3, the lighting element 29 is not formed from a row of light-emitting diodes 31, but the lighting element 29 has a rod-type light guide 33 which has optical interfaces at its lateral front faces 35. Light-emitting diodes 37 as light sources are assigned in each case to the optical interfaces 35 in the light guide 33. The light of said light sources is introduced into the light guide 33 via the optical interfaces 35. Furthermore, the light guide 33 has light exit faces extending in the lateral direction y of the appliance, by which the light can exit downwards in a uniformly distributed manner.

Figure 4:
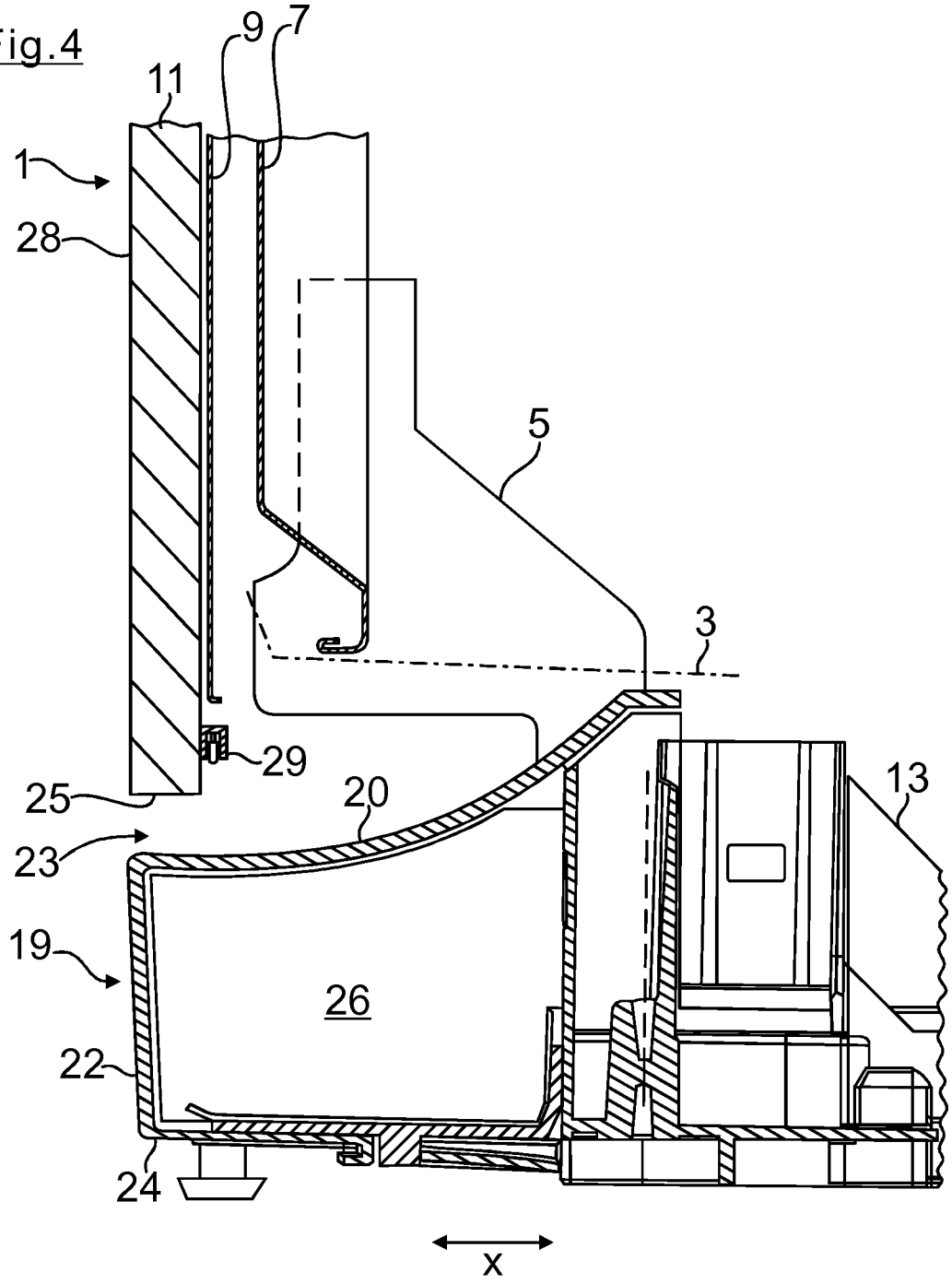
FIG. 4 shows a view corresponding to FIG. 2 of a dishwasher according to the second exemplary embodiment.

FIG. 4 shows a further exemplary embodiment whose construction is identical to that of FIG. 2. In contrast to FIG. 2, the lighting element 29 is not permanently attached to the housing and mounted on the hinge brackets, but rather to a rear face of the cabinet panel 11 of the appliance door 1. In this case the lighting element is therefore motion-coupled to the appliance door 1.

LIST OF REFERENCE NUMBERS

1 Appliance door
3 Wash container
5 Component
7 Inner door panel
9 Outer door panel
11 Cabinet panel
13 Mounting base
19 Plinth cover
20 Top wall
22 Front wall
23 Movement gap
24 Bottom wall

25 Lower edge
28 Front face
29 Lighting element
31 Light source
33 Light guide
35 Optical interface
37 Light source
a Offset dimension
Δh Height difference
x Mounting depth direction
y Lateral direction of the appliance

The invention claimed is:

1. A dishwasher, comprising:

a wash container;

a mounting base disposed underneath the wash container and having a front portion;

an appliance door having a front face;

a support disposed on the front portion of the mounting base, the support having a front face that is proximate to but not flush with the front face of the appliance door;

a bottom-side plinth cover mounted on the support, said plinth cover having a front wall aligned essentially flush with the front face of the appliance door, said plinth cover having a top wall which faces a lower edge of the appliance door and is spaced from the lower edge of the appliance door to allow for an opening movement of the appliance door across a free movement gap; and at least one lighting element which extends in a lateral direction of the dishwasher over an entire width of the dishwasher and which is configured to illuminate the movement gap between the lower edge of the appliance door and the top wall of the plinth cover, wherein the lighting element is located in a mounting at a bottom-side of the appliance door behind the front face of the appliance door, wherein the top wall of the plinth cover has a profile formed with a curved trough shape which follows an approximate shape of a pivoting movement of the lower edge of the appliance door, wherein the support has an upper edge which has a curved shape that is complementary and adjacent to the curved trough shape of the top wall of the plinth cover, and wherein the curved trough shape of the top wall of the plinth cover is configured as a reflector which deflects light of the lighting element essentially horizontally outwards through the movement gap, such that the movement gap is uniformly illuminated over the entire width of the dishwasher.

2. The dishwasher of claim 1 constructed in the form of a free-standing dishwasher or a high-level built-in dishwasher.

3. The dishwasher of claim 1, wherein the lighting element is positioned inside the dishwasher behind the front face of the appliance door.

4. The dishwasher of claim 1, wherein the lighting element is placed at a height difference above the lower edge of the appliance door.

5. The dishwasher of claim 1, wherein the lighting element is located in a mounting depth direction by an offset dimension behind the front face of the appliance door.

6. The dishwasher of claim 1, wherein the lighting element is retained at a rear face of the appliance door, which faces away from the front face of the appliance door.

7. The dishwasher of claim 1, further comprising a fixed housing component, said lighting element being retained independently of the appliance door at the fixed housing component.

8. The dishwasher of claim 1, wherein the lighting element has a light guide having at least one optical interface into which light of a light source is introducible.

9. The dishwasher of claim 8, wherein the light guide extends in a lateral direction essentially over an entire width of the dishwasher.

10. The dishwasher of claim 9, wherein the light guide has in the lateral direction opposing front faces which have optical interfaces for disposition of light sources, respectively.

11. The dishwasher of claim 1, wherein the lighting element comprises a plurality of light-emitting diodes arranged in a row in the lateral direction of the dishwasher.

* * * * *